United States Patent [19]

Souter et al.

[11] Patent Number: 4,895,771

[45] Date of Patent: Jan. 23, 1990

[54] ELECTRICAL CONTACT SURFACE COATING

[75] Inventors: John W. Souter, Autumn; Michael C. Nottingham, Westbrook, both of United Kingdom

[73] Assignee: AB Electronic Components Limited, Great Britain

[21] Appl. No.: 206,564

[22] Filed: Jun. 14, 1988

[51] Int. Cl.[4] ..... C25D 5/12; H01R 13/03

[52] U.S. Cl. ..... 428/670; 204/44.6; 428/672

[58] Field of Search ..... 428/670, 672; 204/44.6

[56] References Cited

U.S. PATENT DOCUMENTS 4,699,697 10/1987 Higuchi ..... 428/670
4,743,346 5/1988 Graham et al. ..... 428/670

FOREIGN PATENT DOCUMENTS 2186597 8/1987 United Kingdom .
8505381 12/1985 World Int. Prop. O. ..... 204/44.6

OTHER PUBLICATIONS

Witlaw, K. J.; "An Extended Study of Acid Gold and . . . ", Metals Abstract 85(4):58–343, 1985.
Simanova et al.; "Replacement of Gold in Technical . . . ", Chem. Ab. CA 107(6):44454h 1987.
Witlaw, Keith; "Palladium–Nickel Deposits Instead of . . . ", Chem. Ab. CA 102(24):213318w 1985.
Dennis et al; "*Nickel and Chromium Plating*", Halsted Press, 1973 p. 79.

*Primary Examiner*—L. Dewayne Rutledge
*Assistant Examiner*—David W. Schumaker
*Attorney, Agent, or Firm*—Thomas E. Sisson

[57] ABSTRACT

A surface for providing an electrically conductive surface coating on an electrical contact body. The process resulting in such a coating comprises the steps of depositing upon the body surface in sequence, (a) a nickel layer, (b) a first gold layer, (c) a palladium/nickel alloy layer which may be an alloy containing nickel up to a proportion of 50% by weight, and (d) a second gold layer. All the layers may be deposited by an electrodeposition process.

The resulting surface coating has excellent corrosion and wear resistance properties.

7 Claims, No Drawings

ELECTRICAL CONTACT SURFACE COATING

This invention relates to an electrical contact surface coating. It relates particularly to a process for providing a surface coating on an electrical contact body which will have good corrosion and wear resistance properties.

In the construction of electrical connectors for linking the separate parts of electrical equipment it is necessary to provide contact bodies which are capable of making good electrical contact with one another and will be able to do this even after the contact surfaces have been exposed to atmospheric conditions likely to cause surface corrosion of the bodies. The products of any surface corrosion are likely to include the formation of an electrically insulating film on the contact body and the occurence of this will cause an unacceptably high electrical resistance between a pair of the contact surfaces. In addition the contact bodies may need to be brought into contact with one another very many times over the lifetime of the equipment so that the contact-making surface will need to be resistant to mechanical wear.

Some of these problems can be reduced by the use of gold as the contact surface coating. Whilst gold generally has good corrosion resistance, use of this element can lead to an increased cost of manufacture of the contact-making bodies. The provision of an alternative suitable coating material would therefore be advantageous.

According to the invention, there is provided a process for forming an electrically conductive surface coating on an electrical contact body, the process comprising the steps of depositing upon the body surface in sequence (a) a nickel layer, (b) a first gold layer, (c) a palladium/nickel alloy layer which may be an alloy containing nickel up to a proportion of 50% by weight, and (d) a second gold layer.

Preferably, the separate layers are laid down by an electro-deposition process such as electroplating.

The nickel layer may be laid down so as to give a deposit of pure, soft, low stress nickel. The relevant plating bath should be free of organic impurities and traces of metals other than nickel.

The first gold layer may be deposited from a conventional commercially available gold plating solution. A gold thickness of between 0.05 to 0.1 to micrometers is laid down.

The palladium/nickel alloy layer may be deposited from a conventional commercial electroplating solution. The composition of the layer is satisfactory with palladium in the range of 50 to 100% by weight, balance nickel.

The second gold layer may be a pure gold metal or one containing metal hardening additives, such as cobalt, nickel or iron in amounts of approximately 0.2 to 0.5% by weight. One preferred composition for the second gold layer is similar to that used for the said first gold layer.

The invention also comprises an electrical contact body when manufactured with an electrically conductive surface coating having layers deposited in sequence of nickel, gold, palladium/nickel alloy and gold. The electrical contact body may be intended for use in applications such as electrical and electronic connector contacts, sliding contacts for electrical slip-rings and for printed circuit boards.

An electrical contact body after suitable cleaning and possibly a surface smoothing treatment is passed through a first electroplating bath where it is given a coating of a pure, soft, low stress nickel deposit. The nickel plating solution composition should be free of organic impurities and traces of metals other than nickel. In order to achieve this, the nickel plating solution may have been given a preliminary carbon treatment to remove organic impurities and been subject to a low current plating-out stage to remove any metal impurities.

The nickel plating solution should therefore preferably contain only nickel salts and possibly an additive such as boric acid. The thickness of nickel deposited is within the range of 0.5 to 3.0 micrometers.

After deposition of the nickel layer, the contact body is washed and it is then passed through a second electroplating bath for the formation of a gold layer. The gold plating solution was a conventional commercial gold plating solution and a thickness of gold of between 0.05 and 0.1 micrometers was formed.

One gold plating solution that was found to be particularly suitable was that produced by Degussa (West Germany) under the name of "Auruna 553 Solution".

The object of the nickel coating followed by the gold coating was partly to promote the formation of a low porosity coating in the palladium/nickel alloy layer that was to be applied subsequently and thus the gold enhanced the eventual corrosion resistance. In addition, the nickel and gold coatings served to reduce the possibility of a chemical contamination of the palladium/-nickel electroplating solution used in the next stage by the accidental dissolution of metals such as copper, zinc or lead from the substrate material.

After deposition of the gold layer, the contact body is washed and it is then passed through a third electroplating bath for the formation of a palladium/nickel alloy layer. The palladium/nickel alloy deposition bath was a commercially available bath selected from a group comprising: Degussa (West Germany)—"Palladium Nickel 462 Solution", Englehard Industries—"Palnic Solution", Lea Ronal—"Pallamet 30 Solution" and Sel-Rex (Oxymetal Industries)—"Palladex Solution". The conditions of deposition used were those recommended by the supplier of the relevant electroplating solution.

The composition of the palladium/nickel alloy layer was found to be satisfactory with palladium in the range of 50 to 100% by weight, balance nickel.

After deposition of the alloy layer, the contact body is washed and it is then passed through a fourth electroplating bath 5 to be given a thin plating of gold. The object of this step was to give a satisfactory wear resistance to the completed contact body and the type of gold deposit laid down was not found to be critical. The type of gold used may be either a pure gold metal or one containing metal-hardening additives, such as cobalt, nickel or iron in an amount of approximately 0.2 to 0.5% by weight.

A particularly suitable gold deposition bath for the second gold layer is a similar bath to that used for the first gold layer.

After removing the plated contact body from the final bath and washing and drying the body, it was able to be tested to determine the wear and corrosion resistance of the resulting multi-layer surface coating.

As a result of the testing processes carried out, the coating was found to have improved corrosion resistance and good wear resistance properties as compared with an electrical contact body having a conventional surface coating.

The method of application of the electroplated layers to the contact body was found to be able to be carried out by any suitable electroplating technique such as barrel plating, vat plating or selective plating.

The foregoing description of an embodiment of the invention has been given by way of example only and a number of modifications may be made without departing from the scope of the invention as defined in the appended claims. For instance, instead of the electrical contact surface coating being laid down by an electrodeposition process, it might be possible to use a suitable alternative process such as an inlaid coating where the materials required for the different surface coatings are rolled into contact with one another.

We claim:

1. A process for providing an electrically conductive surface coating on an electrical contact body comprising the steps of depositing upon the surface of said body in sequence, (a) a nickel layer, (b) a first soft, pure gold layer, (c) a palladium/nickel alloy layer containing nickel up to a proportion of 50% by weight, and (d) a second gold layer.

2. A process as claimed in claim 1, in which at least one of said layers is deposited by an electrodeposition process.

3. A process as claimed in claim 1 in which said nickel layer is a deposit of a pure, soft, low stress nickel coating.

4. A process as claimed in claim 1 in which said first gold layer has a thickness of between 0.05 to 0.1 micrometers.

5. A process as claimed in claim 1 in which said second gold layer is of a pure gold metal.

6. A process as claimed in claim 1 in which said second gold layer is a gold alloy containing metal hardening additives selected from the group consisting of cobalt, nickel and iron.

7. An electrical contact body comprising a surface coating deposited upon said body by a first deposition of a nickel layer, a second deposition of a first soft, pure gold layer, a third deposition of a palladium/nickel alloy layer, said alloy layer further comprising nickel up to a proportion of 50% by weight, and a fourth deposition of a second gold layer.

* * * * *